United States Patent [19]

Voelz et al.

[11] 4,167,957

[45] Sep. 18, 1979

[54] HYDROCARBON FUEL DISPENSING, VAPOR CONTROLLING SYSTEM

[75] Inventors: Frederick L. Voelz, Orland Park; Peter P. Moskovich, Flossmoor, both of Ill.; William J. Kosinski, Longwood, Fla.

[73] Assignee: Atlantic Richfield Company, Philadelphia, Pa.

[21] Appl. No.: 888,055

[22] Filed: Mar. 20, 1978

[51] Int. Cl.[2] ..... B65B 3/18

[52] U.S. Cl. ..... 141/95; 141/198; 141/290; 141/DIG. 2

[58] Field of Search ..... 141/59, 93-96, 141/192, 198, 206-229, 285, 301, 302, 290, 392, DIG. 2; 137/806, 836, 557, 558

[56] References Cited

U.S. PATENT DOCUMENTS

| | | | |
|---|---|---|---|
| 3,996,977 | 12/1976 | Hansel | 141/285 |
| 3,996,979 | 12/1976 | Barr et al. | 141/302 |

*Primary Examiner*—Richard E. Aegerter
*Assistant Examiner*—Frederick R. Schmidt
*Attorney, Agent, or Firm*—Frank J. Uxa; Stanley M. Welsh

[57] ABSTRACT

An improvement in a liquid dispensing, vapor controlling system is disclosed. The improvement senses and responds to the presence of liquid flowing in the vapor passageway of the system and, as preferred, to the existence of an abnormal pressure in a liquid receiver with which the system is utilized.

20 Claims, 5 Drawing Figures

HYDROCARBON FUEL DISPENSING, VAPOR CONTROLLING SYSTEM

BACKGROUND OF THE INVENTION

The present invention relates to a liquid dispensing, vapor controlling system. More particularly, the present invention relates to an improvement in such a system for sensing and responding (1) to the flow of liquid in the vapor passageway thereof, and (2) to the existence of an abnormal pressure in a liquid receiver with which the system is utilized.

In a variety of industries, volatile liquids are stored in bulk and dispensed in small, metered quantities to liquid receivers. For example, in the industry of servicing hydrocarbon burning vehicles, e.g., autmobiles, liquid hydrocarbon fuel, e.g., gasoline, is often stored at service facilities in underground storage tanks and intermittently dispensed to the fuel tanks of the vehicles in metered quantities. To contain the hazardous vapors released from a liquid receiver during such a liquid dispensing operation, and prevent overfilling of the liquid receiver, a variety of liquid dispensing, vapor controlling systems have been disclosed. In the vehicle service industry, such systems typically include a nozzle having a spout, a vapor collector mounted on the nozzle about the spout, a vapor passageway open to the vapor collector, and an overfill sensor on the tip of the spout. Ideally, vapors are collected in the vapor collector passed through the vapor passageway while fuel is dispensed out the spout, and the overfill sensor triggers termination of the fuel dispensing operation whenever the fuel tank is full. However, because of styling considerations and space limitations, some automobiles have been produced which have fuel tank fillpipes so located and oriented that fuel cannot be dispensed into the fuel tanks thereof without overflow and overfill not sensed by a conventional overfill sensor. Consequently, a large quantity of liquid fuel may circulate through the vapor collector and the vapor passageway during the dispensing of fuel to such a vehicle. As a result of this circulation, the meter reading of the quantity of fuel dispensed to the automobile may be inaccurate, and liquid fuel may block the vapor passageway. If the vapor passageway is blocked for any reason, the fuel tank may be pressurized beyond a safe, maximum limit.

SUMMARY OF THE INVENTION

In light of the problems set forth above, a principal object of the present invention is to provide an improvement in a liquid dispensing, vapor controlling system. Specifically, a principal object of the invention is to provide an improvement in a liquid hydrocarbon fuel dispensing, hydrocarbon vapor controlling system.

Another object of the present invention is to provide an improvement which may be utilized with secondary, vapor balance and hybrid type liquid dispensing, vapor controlling systems.

A further principal object of the present invention is to provide an improvement for sensing and responding to the presence of liquid flowing in the vapor passageway of such a system.

A further principal object of the present invention is to provide an improvement for sensing the existence of a pre-selected pressure, e.g., a reduced pressure relative to the safe maximum pressure, in a liquid receiver, e.g., an automobile fuel tank.

Another object of the present invention is to provide an improvement for activating a signal device such as a mechanical indicator, a warning light, an audial alarm, an electrical switch and the like which device may also terminate the liquid dispensing operation.

Another object of the present invention is to provide an improvement which necessitates no modification of the liquid receiver, e.g., the automobile fuel tank.

Another object of the present invention is to provide an improvement, the sensors of which may be mounted within the dispensing nozzle or adjacent the heel thereof within the vapor passageway.

Another object of the present invention is to provide an improvement which operates reliably without regard to the orientation or position of the dispensing nozzle.

A further object of the present invention is to provide an improvement which presents a minimal hazard of explosion of the vapors being controlled.

Still further objects of the present invention are to provide an improvement which is durable, requires a low level of maintenance, is mechanically streamlined and low in production cost.

Thus, in a principal aspect, the present invention is an improvement of apparatus in a liquid dispensing, vapor controlling system having a vapor passageway. In one embodiment, the present apparatus provides for sensing and responding to the presence of liquid flowing in the vapor passageway. Utilized with the apparatus is means for supplying a flow of gas, preferably selected from the group consisting of air, hydrocarbon vapor and mixtures thereof, and means for generating a signal in response to a predetermined gas flow.

The apparatus includes sensor means for defining a port opening into the vapor passageway. The port is located within the vapor passageway so that when a pre-selected level or amount, i.e., time rate, of liquid is flowing therein, the port is at least partially blocked with liquid.

The improvement further includes control means having a first inlet, a second inlet, an outlet and fluidic means, the first inlet being connected to the sensor means, the second inlet being connected to the supply means, and the outlet being connected to the signal means. The control means is for causing gas to flow in the sensor means, for automatically monitoring the gas flow therein and for generating the predetermined gas flow in the outlet whenever the pressure in the sensor means exceeds a pre-determined value. The pressure in the sensor means increases when the port becomes at least partially blocked with liquid and/or when the pressure in the vapor system increases above a predetermined value. Under these conditions, the apparatus triggers a signal whenever a pre-selected level of liquid is flowing in the vapor passageway or the pressure of the vapor system exceeds a predetermined maximum level.

BRIEF DESCRIPTION OF THE DRAWINGS

The preferred embodiments of the present invention will be described in relation to the accompanying drawing, wherein.

DETAILED DESCRIPTION OF THE PREFERRED EMBODIMENTS

Figure 1:
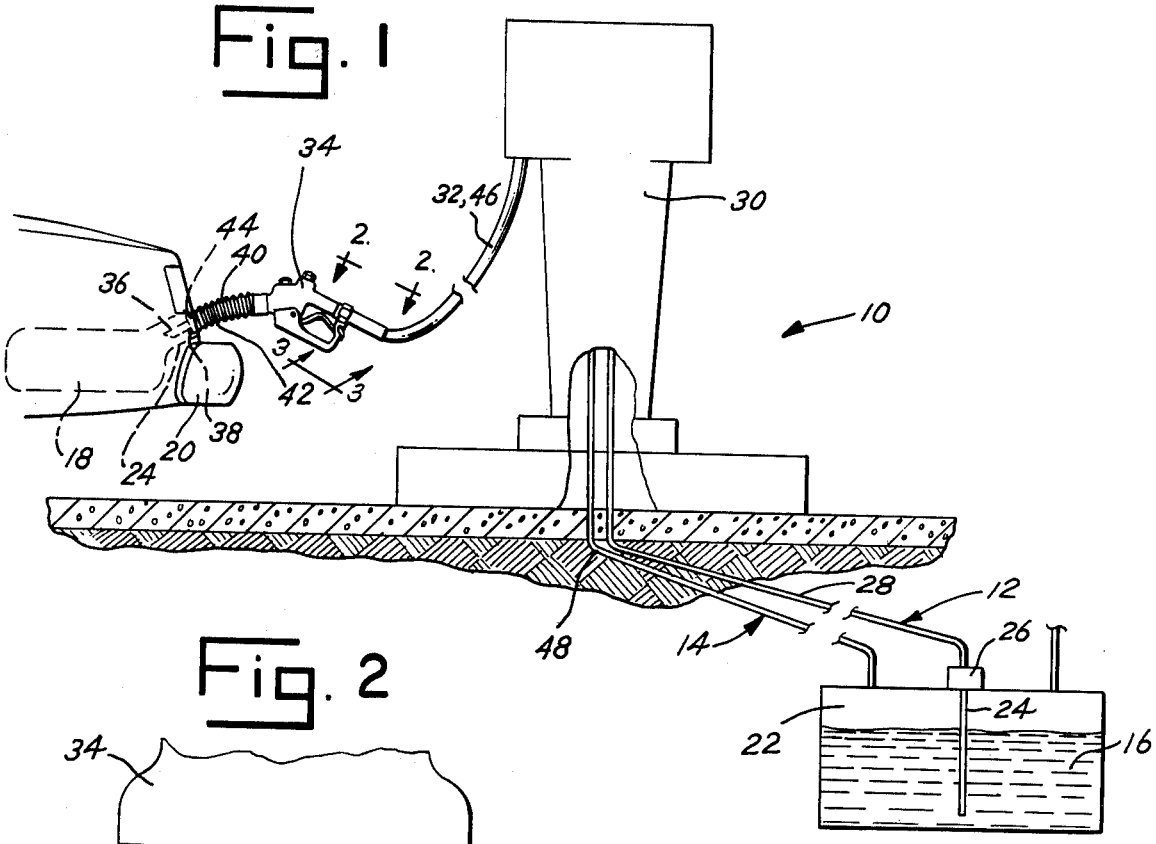
FIG. 1 is an elevational view of a liquid hydrocarbon fuel dispensing, vapor balance, hydrocarbon vapor recovery system incorporating a preferred embodiment of the present invention.

Referring to FIG. 1, the present invention is considered to be suitable for a variety of liquid dispensing, vapor controlling systems. However, because the present invention has particular application to a liquid hydrocarbon fuel dispensing, vapor recovery system 10 of the vapor balance type, the present invention will be described with reference thereto.

Briefly, the system 10 includes a fuel dispensing subsystem 12 and a vapor recovery subsystem 14. The system 10 is utilized to intermittently dispense liquid hydrocarbon fuel, e.g., gasoline, from a source such as an underground storage vessel 16 to the fuel tanks of vehicles, such as the fuel tank 18 of the automobile 20. Vapors displaced from the fuel tank 18 are returned therefrom to the vapor space 22 of the storage vessel 16.

More specifically, the subsystem 12 includes or is connected to a fuel inlet 24 located in the storage vessel 16 and a fuel propelling mechanism such as a turbine 26. Mounted in the vessel 16, the turbine 26 propels gasoline through a fuel passageway, that includes a conduit 28, to an above-ground dispenser 30. From there, the gasoline is delivered through a flexible hose 32 to a dispensing nozzle 34.

As shown, the nozzle 34 has an elongated, generally cylindrical spout 36 which may be placed in the inlet 24 of the automobile fuel tank 18. To automatically retain the spout 36 in the inlet 24, the spout 36 includes a latch mechanism 38. Mounted on the nozzle 34 is a vapor collector such as a flexible bellows 40. The bellows 40 surrounds the spout 36 and has attached to the free end 42 thereof a rigid annular face plate 44. When the spout 36 is placed in the inlet 24 and latched, the bellows 40 flexes or compresses to resiliently maintain a substantially vapor-tight seal between the face plate 44 and the protruding lip of the inlet 24. Thus, gasoline may be dispensed into the fuel tank 18, with the vapors displaced by the entering gasoline collected or captured in the bellows 40.

The dispenser 30 has mounted therein a metering mechanism (not shown) for metering the fuel dispensed to the nozzle 34. As typical, the customer whose automobile is fueled is charged according to a visually displayed reading. Also mounted on the dispenser 30 is a main electrical control or switch (not shown) which is manually tripped to reset the metering mechanism and energize the turbine 26. Overriding the main control is a second control (not shown), mounted in the nozzle 34 and controlled by the movement of the face plate 44. In the vapor balance system shown in the drawings, fuel is thus dispensed out the spout 36 only when the spout 36 is latched to the inlet 24 or when the face plate 44 is firmly held against the inlet 24 by the bellows 40.

In addition to the bellows 40, the vapor recovery subsystem 14 includes a vapor passageway that has a flexible hose 46 thereof open to or in vapor communication with the bellows 40. As desired, the hoses 32, 46 may be physically separated, twinned in a side-by-side relationship or joined coaxially. The hose 46 extends to the dispenser 30 and a conduit 48 open thereto extends to the vapor space 22.

As fuel is dispensed from the storage tank 16 to the automobile 20, the increasing volume of the vapor space 22 results in a decreasing pressure of the vapor therein, while the decreasing volume of the vapor space in the fuel tank 18 results in an increasing pressure of the vapor therein. This pressure difference propels the vapor through the vapor passageway to the vapor space 22.

Figure 2:
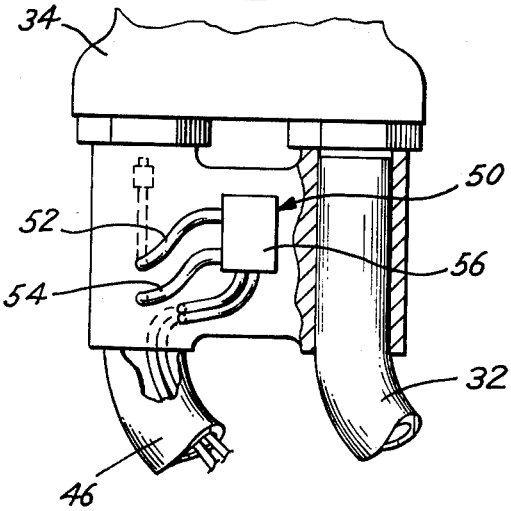
FIG. 2 is a top plan view taken along line 2—2 of FIG. 1, with the fuel passageway of the system depicted in partial cross-section.

In a system 10 as thus described, the first alternative embodiment of the present invention is an apparatus 50 which includes two sensors 52, 54 and a controller 56, utilized with a signal device 58 and a gas supply. As shown in FIG. 2, the sensors 52, 54 are located in the hose 46 adjacent the heel of the nozzle 34, and the controller 56 is mounted thereon. With the sensors 52, 54 and the controller 56 thus located, the apparatus 50 may be added to a pre-existing system 10. It should be understood, however, that the controller 56 may be mounted at any convenient location, for example, on the nozzle 34 or in the dispenser 30 or the like. In a preferred embodiment, the controller 56 is mounted in the dispenser 30 and sensors 52, 54 are elongated conduits which communicate with controller 56 as will be described hereinafter. Further, the signal device 58 may also be conveniently mounted, e.g., on the nozzle 34 or in the dispenser 30 or the like, as desired.

Figure 3:
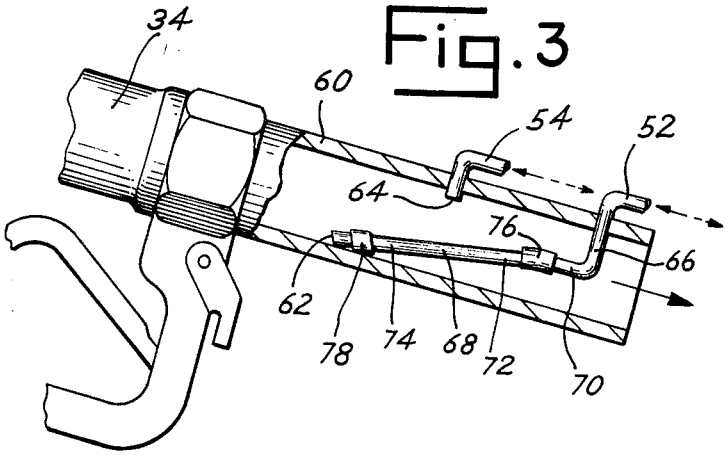
FIG. 3 is a partial, cross-section view of the vapor passageway of the system of FIG. 1, taken along line 3—3 of FIG. 1.

Referring to FIG. 3, the first sensor 52, formed in two sections 66, 68, of substantially rigid tubing having a diameter, for example, of approximately 0.10 inches, is fixedly attached to the sidewall 60 of the hose 46 and extends therethrough to define a first opening or port 62 within the vapor passageway. The second sensor 54, similarly formed, in a single section, extends through the sidewall 60 to define a second opening or port 64. The second port 64 is located adjacent the sidewall 60, toward the top of the hose 46 as oriented when the nozzle 34 is in a typical dispensing position. The second port 64 is thus normally substantially clear of liquid fuel even when liquid flows in the hose 46. As used herein, the term "normally" includes substantially all circumstances except when hose 46 (the vapor passageway) is substantially filled with liquid.

As stated, the first sensor 52 includes two sections 66, 68. The first section 66 is fixedly attached to the sidewall 60 and has an end 70 that turns in the direction of the nozzle 34, i.e., the upstream direction. The second section 68, which is substantially straight, is joined at an end 72 to the end 70 and extends upstream to a free end 74, where the second port 62 is defined. Joining the ends 70, 72 is a flexible coupling 76. Mounted on the free end 74 is a weighted collar 78. The coupling 76 flexes to allow the second section 68 to pivot about the end 72. The free end 74, weighted by the collar 78, thus remains at or near the bottom of the hose 46, in a plurality of orientations of the nozzle 34. As a result, the first port 64 is at least partially blocked with liquid fuel when a predetermined amount of liquid fuel flows in the hose 46.

Figure 4:
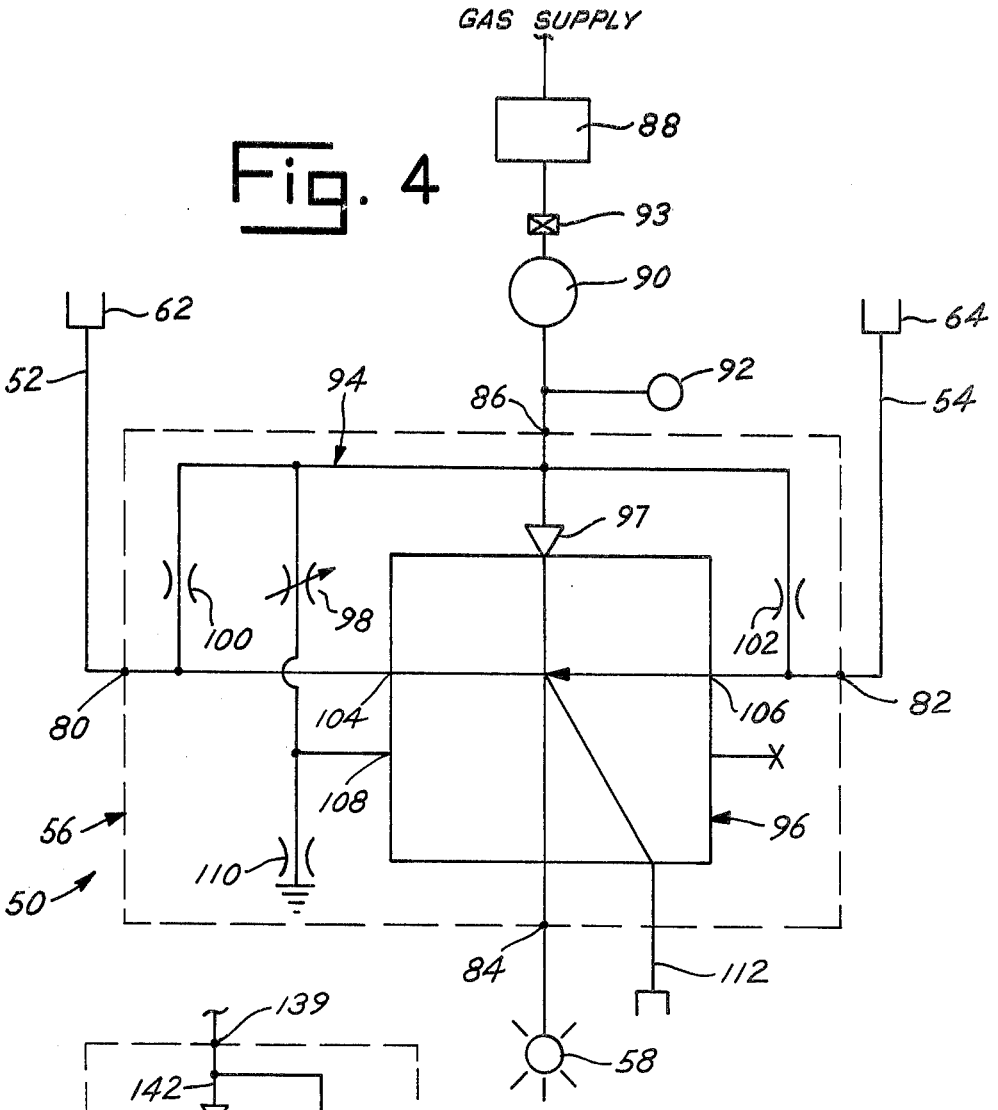
FIG. 4 is a schematic view of a first alternative embodiment of the present invention.

Referring now to FIG. 4, the sensors 52, 54 are connected to the controller 56, which is also connected to the gas supply and to the signal device 58. As preferred, flexible tubing is utilized to make the connections. The first sensor 52 is connected to a first inlet 80 of the controller 56. The gas supply is connected to a second inlet 86 thereof, and the second sensor 54 is connected to a third inlet 82. The signal device 58 is connected to an outlet 84. If the controller 56 and the signal device 58 are mounted in the dispenser 30, tubing from the sensors 52, 54 may be placed within the hose 46, to prevent damage thereto. If, alternatively, the controller 56 is mounted on the nozzle 34, tubing from the gas supply and the signal device 58 may be placed within the hose 46, as shown in FIG. 2.

As preferred, the signal device 58 is an electropneumatic valve or switch or the like for terminating the fuel dispensing operation in response to a predetermined flow at the outlet 84. The apparatus 50 may be utilized, however, with a variety of other pressure-responsive signal devices, such as those which mechanically raise an indicator, flash a warning light, or broadcast an alarm. As stated above, the signal device 58 may be mounted where desired. If, however, a device 58 having electrical components is utilized, it should be mounted away from the nozzle 34, e.g., in the dispenser 30, for safety reasons.

As briefly stated, a gas supply is provided at the second inlet 86. This gas is generated by an air compressor or the like (not shown), filtered through a conventional filter 88 and thereafter reduced in pressure to an operating range of about one-half to about ten psi. by a conventional regulator 90. For observing and adjusting pressure at the second inlet 86, a conventional pressure gauge 92 is placed downstream of the regulator 90.

To conserve energy while fuel is not being dispensed, an automatic valve 93 is included between the filter 88 and the regulator 90. In response to the tripping of the main dispenser switch, the valve 93 opens, allowing gas to flow to the second inlet 86. If desired, one source or compressor may be utilized to supply gas to more than one controller 56. If so, one automatic valve 93 should be located with each controller 56.

Turning now to the controller 56, contained therein is a gas flow circuit 94 including at least one conventional fluidic device. As more preferred, the controller 56 of the first alternative embodiment includes at least one such fluidic device containing a conventional Schmitt trigger 96.

The circuit 94 is so constructed that from the second inlet 86 gas flows in series to the supply inlet 97 of the Schmitt trigger 96, through a variable flow restrictor 98 and through fixed flow restrictors 100, 102. Connected in series with each other and in parallel to the restrictor 100 are the first inlet 80 and the first control input 104 of the Schmitt trigger 96; connected in series with each other and in parallel to the restrictor 102 are the third inlet 82 and the second control input 106 of the Schmitt trigger 96; and connected in series with each other and in parallel to the variable restrictor 98 are the third control input 108 of the Schmitt trigger 96, and a ground or flow outlet 110.

The operation of the apparatus 50 as thus detailed is as follows. When normal or steady state conditions prevail in the vapor recovery hose 46, a slight positive flow of gas moves through the controller 56 to the ports 62, 64 and into the hose 46. In this state, the controller 56 directs the stream of gas entering at the second inlet 86 to a second outlet 112 which is, for example, vented to the atmosphere. No gas flows in a first outlet 84, which is connected to the signal device 58.

When a predetermined amount of liquid fuel flows in the hose 46, the first port 62 becomes at least partially blocked with liquid fuel and the pressure in the first sensor 52 rises above its normal or steady state value. This pressure increase is also present at the first inlet 80. The controller 56 responds to the pressure at the first inlet 80 by diverting the gas which was flowing to the second outlet 112 to the first outlet 84, thus triggering the signal device 58.

When the pressure rises in the fuel tank 18 and, because of the substantially vapor tight seal at the bellows/fillpipe interface, in the hose 46, the pressure at the ports 62, 64 and at the inlets 80, 82 rises. When the pressure rises above a preset value, chosen to allow a safe level of pressure in the fuel tank 18, the controller 56 responds by diverting the gas flowing through the second outlet 112 to the first outlet 84, again triggering the signal device 58. The controller 56 is thus sensitive to liquid fuel flowing in the hose 46 and to the pressure of the fuel tank 18.

Figure 5:
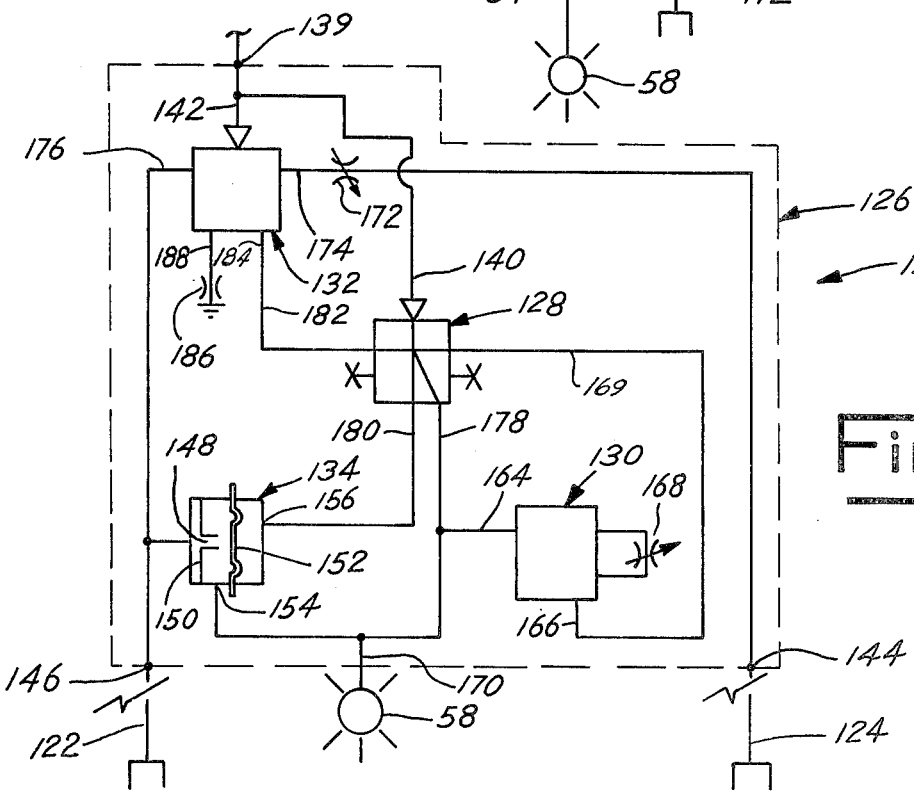
FIG. 5 is a schematic view of a second alternative embodiment of the present invention.

Referring now to FIG. 5, the second alternative embodiment of the present invention is an apparatus 120 including two sensors 122, 124 and a controller 126. The sensors 122, 124 are located in the hose 46 and have all the features of the sensors 52, 54, respectively. The first sensor 124 does, however, extend in the downstream direction, opposite that of the first sensor 52. The controller 126, like the controller 56, includes at least one conventional fluidic device. As shown in FIG. 5, the controller 126 further includes at least one time delay relay device 130, a second conventional fluidic device 132 and a diaphragm device 134.

Supply gas or air is fed through inlet 139 to the fluidic devices 128, 132 at the supply inlets 140, 142 thereof, respectively. A first controller inlet 144 is connected through a variable restrictor 172 with a first control input 174 of the fluidic device 132. A second controller inlet 146 is contacted through a second control input 176 to the fluidic device 132 and an opening 148 to a diaphragm seat 150 of the diaphragm device 134. A flexible diaphragm member 152 therein is movable to and from a position in which the opening 148 is blocked. Movement of the diaphragm member 152 is controlled by the diaphragm inputs 154, 156, which are connected to outputs 178, 180 respectively, of the fluidic device 128.

Connected in parallel with the diaphragm input 154 is a relay input 164 to the time delay relay device 130. A relay output 166 thereof is connected to a control input 169 of the fluidic device 128, and the time delay is set by the variable flow restrictor 168 connected thereto.

A second control input 182 of the fluidic device 128 is connected to a first output 184 of the fluidic device 132, and a second output 188 thereof is connected to a flow outlet 186.

The operation of the apparatus 120 is as follows. During normal conditions in the hose 46, a slight negative flow of gas, i.e., a vacuum, is created in the sensors 122, 124 by the controller 126. As a result, small amounts of vapor are pulled from the vapor return hose 46 through the sensors 122, 124 into the controller 126. In this state, gas flows through the controller 126 and, for example, is vented to the atmosphere. This flow may be caused to pass through a replaceable hydrocarbon trap, to eliminate vapors therefrom. No gas passes through the outlet 170.

When liquid fuel flows in the hose 46, liquid is drawn into the first sensor 122 because of the slight vacuum therein and first sensor 122 becomes blocked with liquid fuel. As a result, the pressure therein increases, and the controller 126 creates a flow in the outlet 170, which triggers an alarm device 58. The controller 126 then directs gas in a positive flow through the sensor 122 and into the hose 46. Consequently, the fuel that blocked the sensor 122 is forcefully expelled. The time delay relay device 130 limits this positive flow so that the apparatus 120 returns rapidly to the normal condition.

When pressure greater than the preset value exists in the hose 46, this is sensed in the sensors 122, 124. When the preset pressure has been present for a time as controlled by a time delay device, the flow of gas through the controller 126 is diverted from its normal outlet to the outlet 170, again triggering the signal device 58. As soon as the pressure is reduced below the preset value, the gas flow returns to its normal outlet.

From the foregoing, it should be apparent to those having average skill in the art that the improvement of the present invention as described herein could be modified and the present invention embodied in alternative equivalent forms. Accordingly, the preferred embodiments should be considered as illustrative and not restrictive, the scope of the claimed invention being measured by the following claims.

What is claimed is:

1. In a liquid dispensing, vapor controlling system having a vapor passageway, the improvement of apparatus for sensing and responding to the presence of a predetermined amount of liquid flowing in the vapor passageway, said apparatus adapted to be utilized with means for supplying a flow of gas and with means for generating a signal in response to a predetermined gas flow, said apparatus comprising, in combination:

sensor means for defining at least one port opening into said vapor passageway, said port located within said vapor passageway so that when a predetermined amount of liquid is flowing therein, said port is at least partially blocked with liquid; and control means having a first inlet, a second inlet, and an outlet, said first inlet connected to said sensor means, said second inlet connected to said supply means, and said outlet connected to said signal means, said control means causing gas to flow in said sensor means for monitoring the gas flow therein and for generating said predetermined gas flow in said outlet whenever the pressure in said sensor means exceeds a preselected value, whereby said apparatus generates said signal in response to a predetermined flow of liquid in said vapor passageway due to and at least partial blockage of said port.

2. An improvement as claimed in claim 1 wherein said control means comprises at least one fluidic device.

3. An improvement as claimed in claim 2 wherein said fluidic device comprises at least one Schmitt trigger.

4. An improvement as claimed in claim 1 wherein said control means comprises a single fluidic device.

5. An improvement as claimed in claim 1 for sensing liquid flowing in a vapor passageway of a system movable to at least two orientations, said port located within said vapor passageway so that in either of said two orientations, whenever a predetermined rate of liquid is flowing in said vapor passageway, said port is at least partially blocked with liquid.

6. An improvement as claimed in claim 1 for sensing liquid flowing in a vapor passageway of a system movable to a plurality of orientations, said port located within said vapor passageway so that in any of said plurality of said orientations, when a predetermined rate of said liquid is flowing in said vapor passageway said port is at least partially blocked with liquid.

7. An improvement as claimed in claim 6 wherein said sensor means includes means for locating said port substantially at the lowest point in a cross section of said vapor passageway in any of said plurality of said plurality of orientations.

8. An improvement as claimed in claim 7 wherein said sensor means includes a first section and a second section having a free end on which said port is defined, said locating means including means for flexibly connecting said first section to said second section and means for weighing said free end toward said lowest point.

9. An improvement as claimed in claim 1 wherein said means for supplying a flow of gas supplies a flow of gas selected from the group consisting of air, hydrocarbon vapor and mixtures thereof.

10. An improvement as claimed in claim 1 wherein said control means causes a positive flow of gas in said sensor means.

11. An improvement as claimed in claim 1 wherein said control means causes a negative flow of gas in said sensor means.

12. An improvement as claimed in claim 11 which further comprises means associated with said control means for expelling blocking liquid from said port after said signal is given.

13. An improvement as claimed in claim 12 wherein said control means causes a positive flow of gas in said sensor means.

14. An improvement as claimed in claim 11 wherein said control means causes a positive flow of gas in said sensor means.

15. An improvement as claimed in claim 1 which further comprises:

second sensor means for defining a second port opening into said vapor passageway, said second port located therein so as to be normally substantially clear of liquid;

said control means further including a third inlet connected to said second sensor means, said control means causing a flow of gas in said second sensor means for monitoring the gas flow therein and for generating the predetermined gas flow in said outlet whenever the pressure in said second sensor means exceeds a predetermined pressure;

whereby said apparatus further generates said signal in response to the existence of said predetermined pressure in said vapor passageway and said second sensor means.

16. The improvement as claimed in claim 15 for sensing liquid flowing the vapor passageway of the system movable to a plurality of orientations, said second port located within said vapor passageway so that in any of said plurality of orientations, said second port is normally substantially clear of liquid.

17. An improvement as claimed in claim 15 wherein said fluidic means comprises at least one fluidic device.

18. An improvement as claimed in claim 15 wherein said fluidic means comprises at least one Schmitt trigger.

19. An improvement as claimed in claim 15 wherein said means for supplying a flow of gas supplies a flow of gas selected from the group consisting of air, hydrocarbon vapor and mixtures thereof.

20. An improvement as claimed in claim 15 wherein said control means causes a positive flow of gas in said sensor means.

* * * * *